US007712538B2

(12) United States Patent
Fay

(10) Patent No.: US 7,712,538 B2
(45) Date of Patent: May 11, 2010

(54) METHOD AND APPARATUS FOR MULTI-POSITIONING A SLEEVE

(75) Inventor: Peter J. Fay, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 196 days.

(21) Appl. No.: 11/854,945

(22) Filed: Sep. 13, 2007

(65) Prior Publication Data

US 2009/0071655 A1 Mar. 19, 2009

(51) Int. Cl.
*E21B 34/14* (2006.01)

(52) U.S. Cl. ..... 166/332.4; 166/332.1; 166/386; 166/381; 166/334.4

(58) Field of Classification Search ..... 166/381, 166/332.1, 386, 334.4, 332.4
See application file for complete search history.

(56) References Cited

U.S. PATENT DOCUMENTS

| | | | | |
|---|---|---|---|---|
| 4,278,131 | A * | 7/1981 | Jani | 166/332.7 |
| 4,436,152 | A | 3/1984 | Fisher, Jr. et al. | |
| 5,183,114 | A | 2/1993 | Mashaw, Jr. et al. | |
| 5,305,833 | A | 4/1994 | Collins | |
| 5,549,161 | A | 8/1996 | Gomez et al. | |

FOREIGN PATENT DOCUMENTS

WO WO2005100743 A1 10/2005

OTHER PUBLICATIONS

Baker Hughes, Baker Oil Tools, Flow Control Systems Technical Unit; "CM Selective Equalizing and Shifting Tool", Sep. 15, 2005; 1-13.
Baker Hughes, Baker Oil Tools Flow Control Systems Technical Unit, "CM Selective Equalizing and Shifting Tool", 6 pages, Sep. 2005.
Daniels, Jim, et al., "High Density CCL Memory Tool to Confirm SSD Sleever Position", SPE 68362, Mar. 2001, 1-9.
Constantine, Jesse J., "Selective Production of Horizontal Openhole Completions Using ECP and Sliding Sleeve Technology", SPe 55618, May 1999, 1-5.
Plauche, Ricky, et al., "Advances in Sliding Sleeve Technology and Coiled Tubing Performance Enhance Multizone Completion of Abnormally Pressured Gulf of Mexico Horizontal Well", SPE 38403, Apr. 1997.

* cited by examiner

*Primary Examiner*—Giovanna C Wright
(74) *Attorney, Agent, or Firm*—Steve Rosenblatt

(57) ABSTRACT

A tool for shifting a sleeve into at least one intermediate position between stops has a shifting key that only can move the sleeve a finite amount before it is forced out of contact with the sleeve. An overpull key is released for engagement with the sleeve before the shifting key is forced out. The overpull key resists movement until a noticeable predetermined force is applied at which point the overpull key is freed from the sliding sleeve for a normal release. If any key fails to release, an emergency release is provided that independently displaces the key so that the tool can be removed. The tool can be operated in either an uphole or a downhole direction to shift the sleeve depending on the orientation of the keys. Embodiments using a single key type are contemplated.

20 Claims, 8 Drawing Sheets

METHOD AND APPARATUS FOR MULTI-POSITIONING A SLEEVE

FIELD OF THE INVENTION

The field of the invention is tools and methods for shifting a sleeve into at least one position between travel end points and incorporating a signal to the surface that such a position has been reached as well as an emergency release feature for the tool.

BACKGROUND OF THE INVENTION

Sliding sleeves are used as downhole valves. They are frequently disposed in a recess in a tubular that defines opposed travel stops that coincide with two positions for the valve. The sleeve typically has a recess at opposed ends so that a known shifting tool can grab it and move the sleeve between stops. The surrounding tubular can have a port and the sleeve can have a second port. When the sleeve is against one stop the port in the tubular can be obstructed. When the sleeve is at the opposite stop, the sleeve port aligns with the tubular port for the open position.

Recently, designs have developed that require a valve member like a sleeve to be in more than two positions defined by its travel stops. In one such application a tubular port needs to be closed in one position, fully open in another and in a third position for alignment of a filter media with the port. In the open position a surrounding formation can be fractured with minimal flow resistance at the wide open port. In the third position, the formation fluids can be produced through the same tubing port with a sand control material in the flow path. In one such design, the sliding sleeve has two ports with one port containing the screen material. A design of this type is shown in PCT/US2005/011869. The problem arises in how the surface personnel can know when the sleeve has obtained an interim position between its travel stops.

One way this has been addressed in the past is to mount the sleeve on a j-slot and move it mechanically or hydraulically through the pattern in the j-slot to define any number of desired positions. This design adds complexity and cost in that in the hydraulic version a ball has to catch on a seat and pressure is cycled a given number of times to get the right position. After that the ball and seat need to get blown out so other procedures further downhole can take place. The drift diameter through the tool is reduced to make room for the pin in slot arrangement.

Another way to do this is using a control line to move a piston that is linked to the sleeve. A finite amount of hydraulic fluid is pumped that corresponds to a given displacement of the piston. However this method has uncertainties relating to the amount of fluid pumped being a small quantity through a long control line which can be subject to thermal effects or even a compressible gas bubble that can through off the amount of the intended movement. Additionally, the drag force of seals or the momentum of the hydraulic piston can also result in a different amount of movement than intended.

The present invention provides a tool and a method for shifting a sleeve to an interim position or positions between travel stops and giving feedback to the surface that the required amount of movement has taken place. In the event of a failure to release an emergency release option is available. The tool resets after a normal release and can be re-engaged if desired. The tool is operable in either direction depending on how its component parts are oriented. These and other details of the present invention will be more readily understood by those skilled in the art from a review of the description of the preferred embodiment and the associated drawings that appear below with the understanding that the appended claims represent the full scope of the invention.

SUMMARY OF THE INVENTION

A tool for shifting a sleeve into at least one intermediate position between stops has a shifting key that only can move the sleeve a finite amount before it is forced out of contact with the sleeve. An overpull key is released for engagement with the sleeve before the shifting key is forced out. The overpull key resists movement until a noticeable predetermined force is applied at which point the overpull key is freed from the sliding sleeve for a normal release. If any key fails to release, an emergency release is provided that independently displaces the key so that the tool can be removed. The tool can be operated in either an uphole or a downhole direction to shift the sleeve depending on the orientation of the keys. Embodiments using a single key type are contemplated.

DETAILED DESCRIPTION OF THE DRAWINGS

FIGS. 1*a*-1*d* represent the run in position with the shifting key secured in the sleeve;

DETAILED DESCRIPTION OF THE PREFERRED EMBODIMENT

Figure 1A:
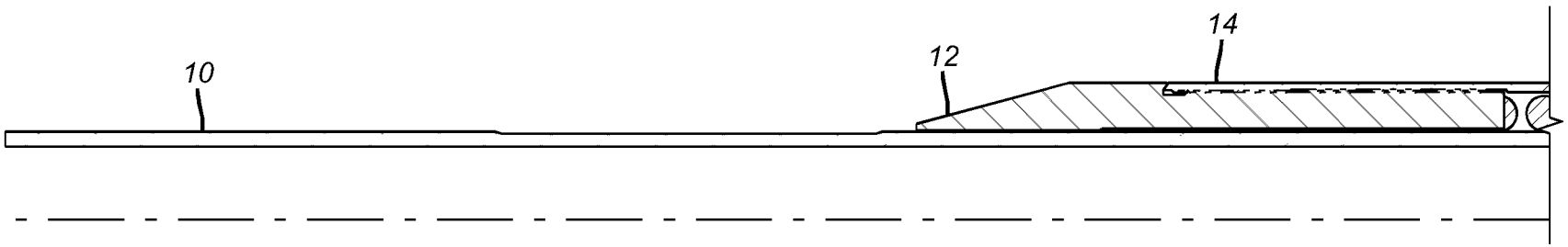
Figure 1B:
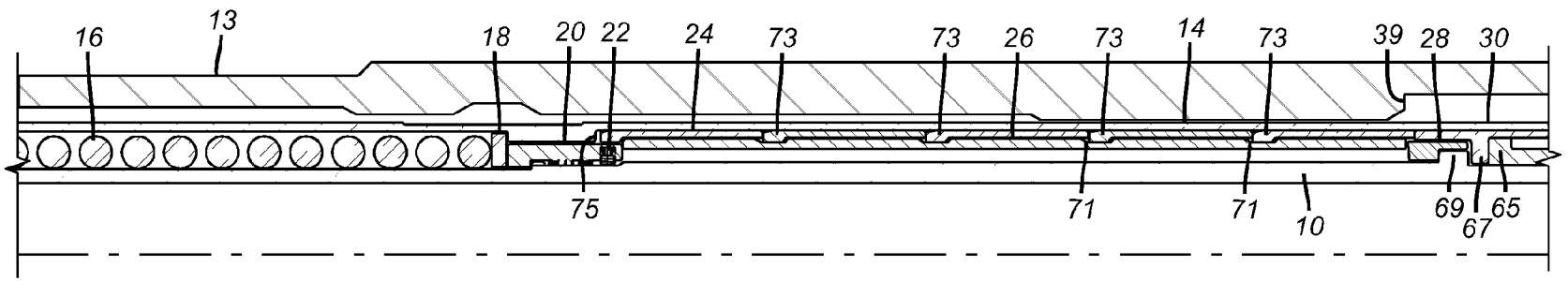
Figure 1C:
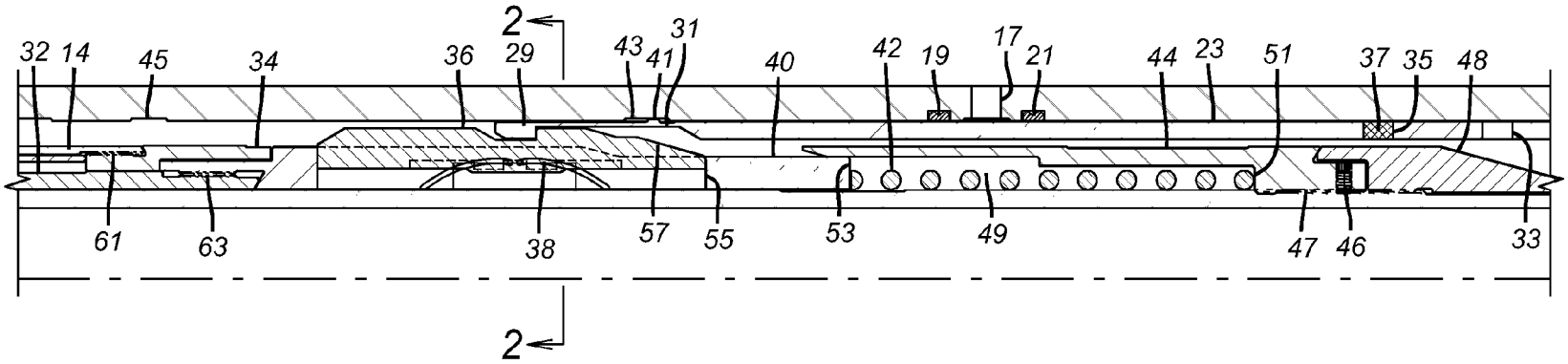
Figure 1D:
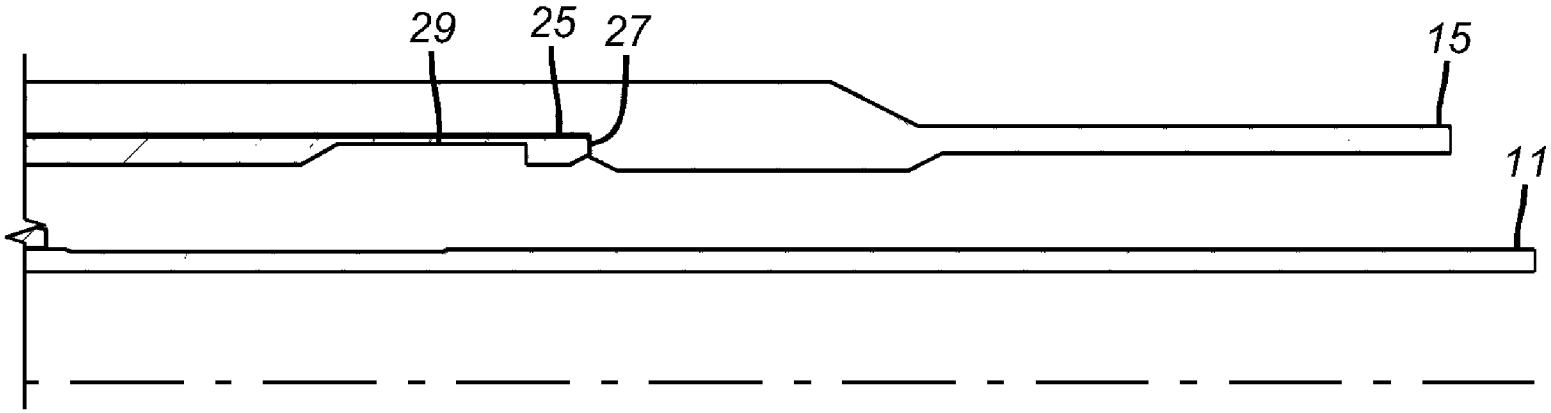

A portion of a tubular string 13 starts in FIG. 1*b* and terminates at 15 in FIG. 1*d*. Those skilled in the art will recognize that string 13 shown in FIG. 1*b* can go from the well surface to further down in the well below 15 but only the portion of interest in understanding the invention is illustrated. That portion has one or more ports 17 which are straddled by seals 19 and 21. A sleeve 23 has a lower end 25 against shoulder 27 inside string 13 as shown in FIG. 1*d*. A fishing neck 29 is close to lower end 25 to allow a shifting tool to latch there to move the sleeve 23 in a downhole direction or to the right when sleeve 23 is positioned off the stop or shoulder 27. Sleeve 23 has an upper end 29 and an adjacent fishing neck 31 where keys 36 and 50 can selectively engage as will be described below. Sleeve 23 has an array of ports 33 that are wide open and can be aligned with ports 17 for the wide open position of the ports 17. In FIG. 1*c* the ports 17 are closed because the sleeve 23 has a blank part straddling the seals 19 and 21. There is a second array of ports 35 that are also capable of being aligned with ports 17. Ports 35 have a sand control medium 37 in them. When ports 35 line up with ports 17, well fluids can be produced through the string 13 to the surface with effective sand control. Those skilled in the art will appreciate that the preferred embodiment uses a specific tool to illustrate a situation where the sleeve needs to go into more than two positions and one of those positions corresponds to the sleeve 23 not being against the shoulder 27 or the opposite shoulder 39.

To hold the sleeve 23 in the run in position of FIG. 1*c* there is a tab 41 that extends into a groove 43 in string 13. Further uphole, another groove 45 is positioned to catch the tab 41 to hold ports 35 of sleeve 23 aligned with ports 17 of string 13, as will be explained below.

Figure 2:
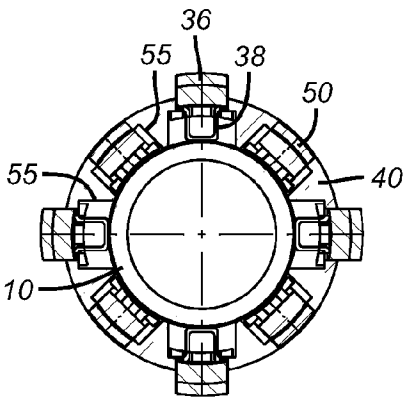
FIG. 2 is the view along lines 2-2 of FIG. 1*c;*
Figure 3:
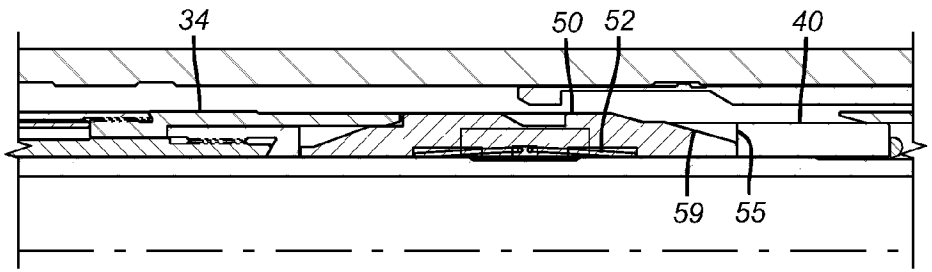
FIG. 3 is the view of FIG. 1*c* but rotated 45° to show the overpull key.

Referring now to the shifting tool that is lowered into sleeve 23, inner mandrel 10 starts in FIG. 1*a* and ends at 11 in FIG. 1*d*. Secured to mandrel 10 at thread 47 is bottom sub 48 which covers a pin 46 designed to keep threaded connection 47 from coming undone. Release sleeve 44 is secured at thread 47. Sleeve 44 spans over key retainer 40 creating a chamber 49 in which spring 42 is located. The downhole end of spring 42 bears on shoulder 51 of release sleeve 44 while the uphole end of spring 42 bears on end 53 of key retainer 40. Key retainer 40 has multiple openings 55 shown in FIGS. 1*c*, 2 and 3 and which are circumferentially offset from adjacent such opening by preferably 45°. Extending through openings 55 in an alternating pattern shown in FIG. 2 are the shifting keys 36 and the overpull keys 50. A spring 38 biases each shifting key 36 radially out through opening 55 and another spring 52 biases each overpull key 50 through its respective window 55. Near the downhole end of the shifting keys 36 is a taper 57 and near the downhole end of the overpull keys 50 is a taper 59. In both instances these tapers allow the keys 36 and 50 to be pushed down against their respective springs and snap out for engagement into fishing neck 31 of sleeve 23 as will be explained below. As shown in FIG. 1*c* simply lowering the mandrel 10 into the string 13 will make the shifting keys 36 retract and snap out into a gripping relation with the sleeve 23. The overpull keys are initially held radially retracted by retainer sleeve 34 as shown if FIG. 3. This sleeve 34 is irregularly shaped so it doesn't overlay shifting keys 36 for run (FIG. 1*c*) in but it does overlay overpull keys 50 for run in (FIG. 3). Sleeve 34 lays on sleeve 32 and is held in place by also abutting key retainer 40 and outer sleeve 14 held at thread 61. Inner sleeve 32 is held to key retainer 40 at thread 63. An upper end tab 65 on inner sleeve 32 abuts tab 67 of sleeve 30 that overlays sleeve 32. Mandrel 10 has a tab 69 against which tab 67 is abutted. Tab 69 supports ring 28 on which rests a collapsing split sleeve 26. Sleeve 26 has a series of grooves 71 in which rest a series of projections 73 of sleeve assembly 24, which may be in one or more pieces.

Mandrel 10 has threaded to it sleeve 20 and that connection is secured by pin 22. Spacer 18 rests on sleeve 20 and spring 16 is on spacer 18. A top sub 12 is secured to outer sleeve 14 and retains the spring 16. Outer sleeve 14 has a shoulder 75 in FIG. 1*b* against which sleeve assembly 24 can abut when not locked into its position in FIG. 1*b* by the collapsing split sleeve 26 that is shown abutting sleeve 20 that is secured to mandrel 10.

The components having been described, the operation of the tool will now be explained. The mandrel 10 is lowered to a shifting sleeve 23 in the string 13. Those skilled in the art will appreciate that more than one sleeve 23 can be shifted in a given trip into the well as one of the features of the invention is that the tool resets after a sleeve shift so that it can be latched to other sleeves. While moving a sleeve 13 to an intermediate position between travel stops 25 and 39 is illustrated, the invention is applicable to moving other types of downhole equipment to one or more intermediate positions between fixed stops. Lowering the mandrel 10 allows the leading taper 57 to engage sleeve 23 so as to compress spring 38 to retract shifting keys 36 to allow them to pass into sleeve 23 and snap out into fishing neck 31, as shown in FIG. 1*c*. At this time the overpull keys 50 are held radially retracted by sleeve 34 as shown in FIG. 3.

Figure 4:
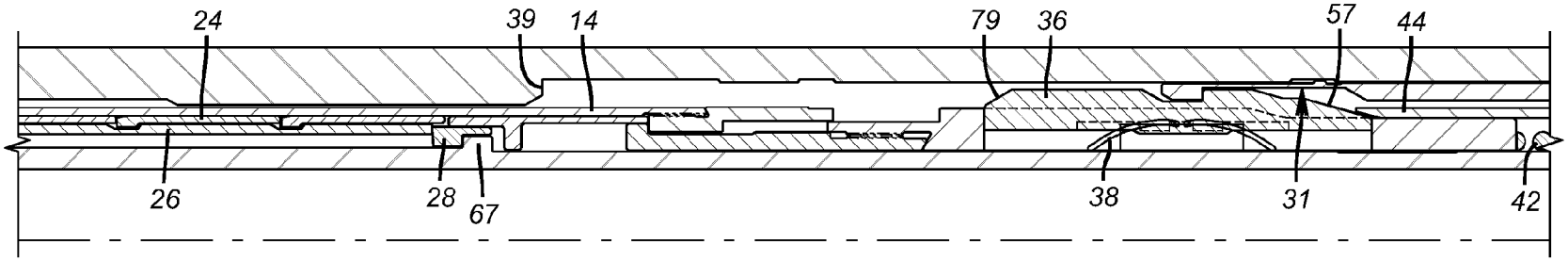
FIG. 4 is the view of FIG. 1*c* with the shifting key engaged for moving the sleeve.
Figure 5:
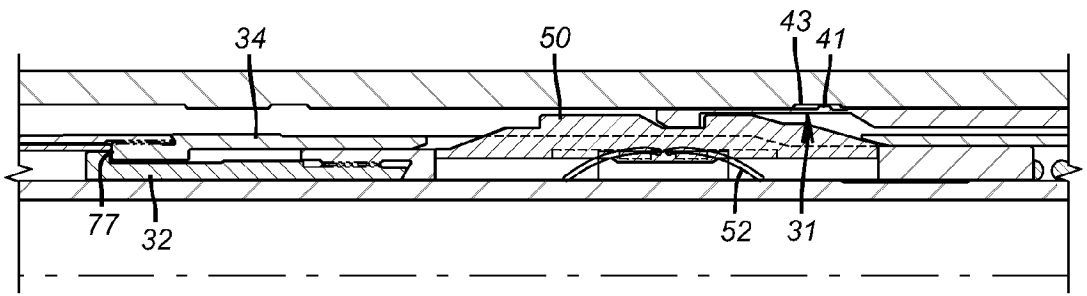
FIG. 5 is the view of FIG. 4 rotated 45° to show the overpull key connected to the sleeve.

A pull on mandrel 10 with shifting keys 36 engaged brings up sleeve 44 close to shifting keys 36, as shown in FIG. 4, while compressing spring 42. In the FIG. 4 position, sleeve 44 does not yet push on tapered surface 57. At the same time, the pulling up of the mandrel 10 retracts sleeve 34 from overpull keys 50 to allow their springs 52 to push them out into fishing neck 31, as shown in FIG. 5. This happens because picking up mandrel 10 lifts tab 67 against ring 28 which pushes up connected rings 24 and 26 that in turn pick up outer sleeve 14 to which sleeve 34 is attached. This upward movement of mandrel 10 can continue until sleeve 34 shoulders against surface 77 of sleeve 32 as shown in FIG. 5. At that time the overpull keys 50 are also engaged in fishing neck 31 as are the shifting keys.

Figure 6:
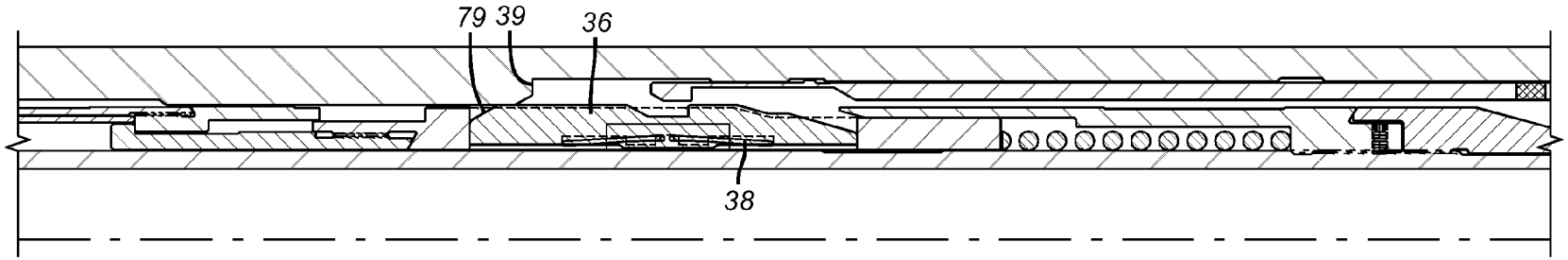
FIG. 6 is the view of FIG. 4 with the sleeve shifted so that the shifting key is forced out of the sliding sleeve.
Figure 7:
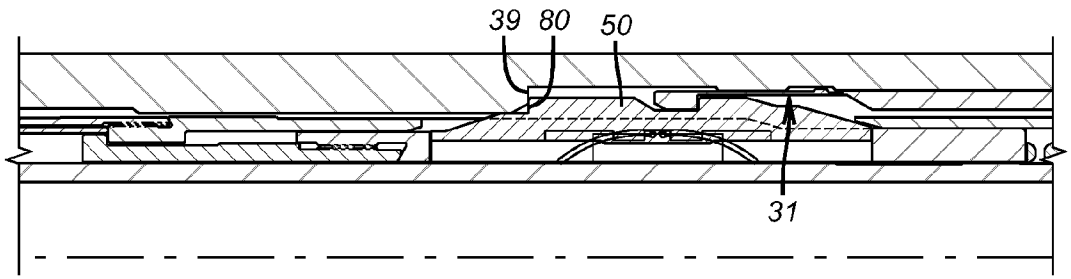
FIG. 7 is the view of FIG. 6 to show the overpull key still registered with the sleeve.

Further pulling on mandrel 10 will now bring up key retainer 40 and with it keys 36 and 50 now both pulling uphole on sleeve 23. Tab 41 will jump out of groove 43 as the sleeve 23 begins to move. After a predetermined movement the tapered uphole end 79 of shifting keys 36 will strike travel stop 39 to force the shifting keys 36 out of fishing neck 31 so that they let go of sleeve 23 and compress springs 38, as shown in FIG. 6. In the FIG. 6 position of the sliding sleeve 23 the keys 36 cannot get another grip on sleeve 23 at fishing neck 31. At the same time in FIG. 7 the overpull keys 50 are still engaged to sleeve 23 at fishing neck 31. The overpull keys have an uphole shoulder 80 that no-goes against shoulder 39 on string 13 as shown in FIG. 7. An overpull force can now be applied as a surface signal. Note that tab 41 is now in groove 81 to hold sleeve 23 in the position where ports 35 and 17 are lined up and to keep it from inadvertently moving if bumped by other tools going into the well at a later time after the shifting tool is removed.

Figure 8:
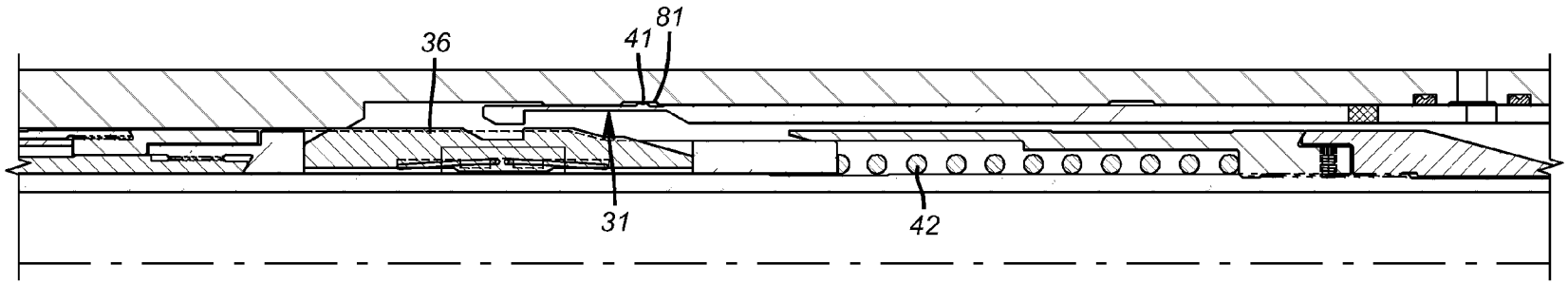
FIG. 8 is the view of FIG. 6 showing that the shifting key can't reenter the sleeve after overpulling with the overpull key.
Figure 9:
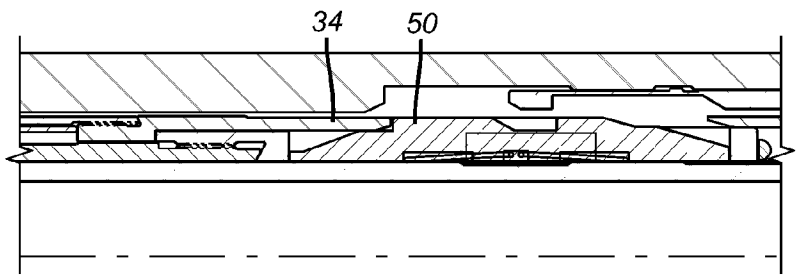
FIG. 9 is the view of FIG. 8 rotated 45° showing the overpull keys retracted from the sleeve.

When the overpulling is done, the mandrel 10 is set down and as shown in FIG. 8, the shifting keys 36 cannot go into fishing neck 31. Setting down weight also allows spring 42 to expand to bring down sleeve 34 back over the overpull keys 50 to hold them radially retracted so as to prevent them from getting a grip on fishing neck 31. At this point an upward pull on mandrel 10 releases the tool and confirms that sleeve 23 shifted the requisite distance to get ports 35 with screens 37 in them into alignment with ports 17 in the string 13. Other sleeves in the wellbore can now be shifted in the same manner in a single trip as the tool is now back to its run in position.

Figure 10:
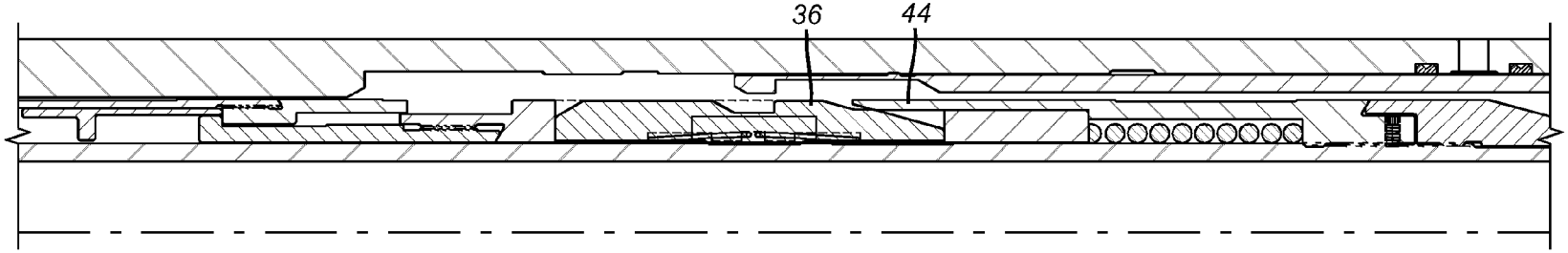
FIG. 10 is the view of FIG. 1*c* showing the emergency release of the shifting key.
Figure 11:
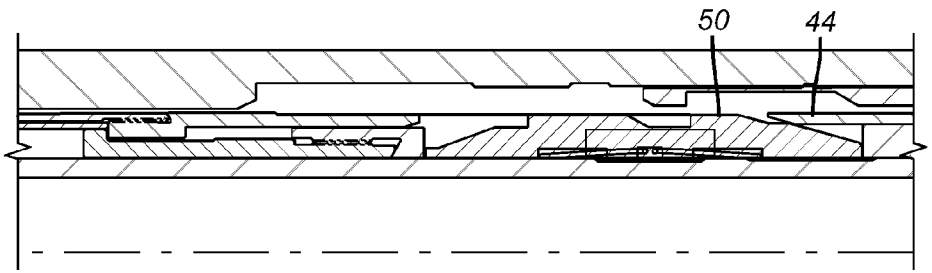
FIG. 11 is the view of FIG. 10 rotated 45°.

If for any reason keys 36 or keys 50 fail to release in the manner described above, the emergency release provisions in the tool allow for its removal. With keys 36 or 50 not releasing, further pulling on mandrel 10 puts an increasing compressive force on split sleeve 26 that ultimately forces it radially inwardly and away from sleeve 26 so that the projections 73 are no longer registered with recesses 71. After that the mandrel 10 can come up against spring 16 taking up with it sleeve 44 that will ride up ramps 57 and 59 of the keys and push them all radially inwardly and out of registry with fishing neck 31. At that point mandrel 10 is released and the tool can be removed from the string 13. It should be noted that once the release occurs springs 42 and 16 relax again to put the tool into the run in position. Projections 73 register again with grooves 71 and the emergency release feature resets as well. FIGS. 10 and 11 show the sleeve 44 moved up to cover the keys 36 and 50 so that the tool can be removed. The tool can be repositioned to operate another sleeve or taken out of the hole to be examined for any malfunction.

Those skilled in the art will appreciate that the present invention has the capability of shifting multiple sleeves or other tools in the same trip where each tool needs to be shifted a finite distance not defined by a downhole fixed travel stop. The tool is capable of giving a surface signal to indicate that the desired shifting has happened. As a confirmation, the shifting keys will not re-engage a given sleeve after it has been shifted to an intermediate position or positions between fixed travel stops. An emergency release is available and it resets after it operates. The keys go back to the run in position after a normal shift and release or after an emergency release. The keys can be oriented in an opposite direction and the tool will function to shift with a downhole force rather than an uphole pull as described. While a handoff between shifting keys and overpull keys has been described, a modification that allows the shifting keys to also serve as overpull keys is contemplated with the shifting keys releasing grip of the sleeve 23 as described above and then getting a second grip in the string 13 that does not release until a predetermined force is applied. This can involve catching a recess in string 13 where an elevated force is needed to release from it. Alternatively, more than 1 repositioning of a given sleeve is possible as well as finding multiple positions between stops moving the sleeve in either direction

I claim:

1. A tool for downhole use, comprising:

at least one housing defining opposed travel stops for a movable member therein;

a shifting tool selectively secured only to said movable member to move said movable member to at least one position between said stops and resettably release from the same location on the movable member when the movable member is between said stops;

said shifting tool adapted to retain said movable member after it is shifted to said position between stops and to resist release to a predetermined overpull force so as to provide feedback that said movable member has been moved.

2. The tool of claim 1, wherein:

said shifting tool is selectively prevented by said housing from moving said movable member when said overpull force is applied.

3. The tool of claim 2, wherein:

said shifting tool is prevented from re-engaging said movable member after shifting and releasing from said movable member.

4. The tool of claim 2, wherein:

said shifting tool is releasable from said movable member by removal of said overpull force and movement of said shifting tool in a direction opposed to said overpull force.

5. The tool of claim 4, wherein:

said shifting tool is also releasable from said movable member by increasing an applied force to a predetermined value above said overpull force and in the same direction.

6. The tool of claim 1, wherein:

said at least one housing comprises multiple housings each with a movable member movable between opposed travel stops;

said shifting tool resets after release from a first movable member so that it can shift a second movable member in another housing to a position between opposed travel stops without removal from downhole.

7. The tool of claim 1, wherein:

said shifting tool comprises at least one shifting key and said movable member comprises a sliding sleeve having at least one neck, said shifting key adapted to grab said neck on insertion of said shifting tool into said sliding sleeve.

8. The tool of claim 7, wherein:

said shifting key is biased into contract with said sliding sleeve and to move in tandem with it as said shifting tool is moved until said shifting key contacts one of said travel stops for said sleeve.

9. The tool of claim 8, wherein:

contact of said travel stop by said shifting key overcomes said bias on it as said shifting key moves away from said neck of said sliding sleeve;

said neck remains retained by at least one overpull key mounted on said shifting tool as said shifting key is forced out of said neck.

10. The tool of claim 9, wherein:

said overpull key moves in tandem with said sliding sleeve until said overpull key hits one of said travel stops for said sliding sleeve at which time said sliding sleeve has moved to the point where said shifting key cannot re-engage said neck.

11. The tool of claim 10, wherein:

said overpull key is initially retained by a retainer against an outward bias toward said neck, whereupon engagement of said shifting key with said neck and a force delivered to said shifting tool, said retainer is moved away from said overpull key to allow said bias to push it into said neck.

12. The tool of claim 11, wherein:

pulling in a first direction on said shifting tool with said overpull key against said travel stop comprises a signal that said sliding sleeve has shifted to a position between said stops;

said at least one housing comprises multiple housings each with a sliding sleeve movable between opposed travel stops;

moving said shifting tool in a second direction opposite said first direction repositions said retainer over said overpull key so that the shifting tool can be redeployed downhole to shift another sliding sleeve in another housing while remaining downhole or removed from downhole.

13. The tool of claim 12, wherein:

pulling in said first direction on said shifting tool with said overpull key against said travel stop beyond a predetermined force allows at least a portion of said shifting tool to move with respect to another portion retained by engagement of at least one key to said neck to bring a second retainer over all said keys to force them away from said neck for an alternative release of said shifting tool.

14. The tool of claim 13, wherein:

said portions of said shifting tool are biased away from each other by a first spring so as to force said second retainer away from said keys after said keys are forced out of said neck.

15. The tool of claim 14, wherein:

said second retainer engages said keys on an opposite end from where said first retainer engages said overpull key.

16. The tool of claim 15, wherein:

said first retainer is biased by a second spring to retain said overpull key; and application of force to said shifting tool with said shifting key engaged to said neck overcomes said bias of said second spring on said first retainer.

17. The tool of claim 16, wherein:

relative movement of portions of said shifting tool in response to said predetermined force is made possible by collapse of a split sleeve that allows applied force to create said relative movement while compressing said first spring.

18. The tool of claim 17, wherein:

said housing comprises a groove and said sliding sleeve comprises a tab which is engages to said groove to retain a sliding sleeve position between its travel stops.

19. The tool of claim 18, wherein:

said housing comprises a first array of ports;

said sliding sleeve comprises a second array of unobstructed ports and a third array of ports with a sand control medium in them;

said first array of ports are aligned with said second array of ports when said sliding sleeve is against one of its travel stops and with said third array of ports when said sliding sleeve is away from said stops.

20. The tool of claim 1, wherein:

said housing comprises a first array of ports;

said movable member comprises a second array of unobstructed ports and a third array of ports with a sand control medium in them;

said first array of ports are aligned with said second array of ports when said movable member is against one of its travel stops and with said third array of ports when said movable member is away from said stops.

* * * * *